US007094080B2

(12) United States Patent
Dickie et al.

(10) Patent No.: US 7,094,080 B2
(45) Date of Patent: Aug. 22, 2006

(54) SAFETY DEVICE FOR ELECTRICAL PLUGS AND A METHOD OF ATTACHING THE SAME

(75) Inventors: Robert G. Dickie, Newmarket (CA); David B. Snaith, Toronto (CA)

(73) Assignee: American Tack & Hardware Co., Inc., Saddle River, NJ (US)

( * ) Notice: Subject to any disclaimer, the term of this patent is extended or adjusted under 35 U.S.C. 154(b) by 0 days.

(21) Appl. No.: 11/079,629

(22) Filed: Mar. 14, 2005

(65) Prior Publication Data

US 2005/0159031 A1 Jul. 21, 2005

Related U.S. Application Data

(63) Continuation of application No. 10/713,375, filed on Nov. 14, 2003.

(51) Int. Cl.
*H01R 13/44* (2006.01)

(52) U.S. Cl. ..... 439/141

(58) Field of Classification Search ..... 439/141, 439/140, 149, 137
See application file for complete search history.

(56) References Cited

U.S. PATENT DOCUMENTS 3,499,706 A * 3/1970 Hall et al. ..... 352/235
3,629,790 A 12/1971 McSherry, Jr.
3,631,320 A * 12/1971 Eckert ..... 361/1
3,682,315 A * 8/1972 Kelly ..... 439/141
3,763,457 A 10/1973 Whippo
4,810,199 A 3/1989 Kar
5,030,119 A 7/1991 Lowe
5,423,689 A * 6/1995 Valentino ..... 439/141
6,062,881 A * 5/2000 Ellison ..... 439/141
6,231,358 B1 * 5/2001 Kerr et al. ..... 439/140
6,337,541 B1 1/2002 Dickie et al.
6,577,081 B1 6/2003 Dickie et al.
6,604,954 B1 * 8/2003 Chu et al. ..... 439/140

* cited by examiner

*Primary Examiner*—Gary F. Paumen
(74) *Attorney, Agent, or Firm*—Sand & Sebolt

(57) ABSTRACT

A safety device for preventing accidental contact of a user's fingers with the live blades of an electrical plug during inserting or removal of the plug from a wall socket and a method for attaching the safety device to an electrical plug. The safety device includes a housing with a collapsible shield and a connector for connecting the housing to the front end of the electrical plug. The shield extends outwardly from the front end of the housing and surrounds the blades when the safety device is attached to the plug. The connector comprises a pair of opposing detents that extend outwardly away from the rear wall of the housing. The detents flex to allow the front end of the plug to pass between them but do not allow the front end of the plug to be withdrawn therethrough. The shield collapses toward the front end of the housing when the plug is inserted into a wall socket and re-expands to its original position when the plug is withdrawn from the wall socket.

20 Claims, 2 Drawing Sheets

SAFETY DEVICE FOR ELECTRICAL PLUGS AND A METHOD OF ATTACHING THE SAME

CROSS REFERENCE TO RELATED APPLICATIONS

This is a Continuation-in-Part of U.S. patent application Ser. No. 10/713,375, filed Nov. 14, 2003, the entire specification of which is incorporated herein by reference.

BACKGROUND OF THE INVENTION

1. Technical Field

This invention generally relates to electrical plugs. More particularly, the invention relates to a safety device which may be attached to an electrical plug for preventing the user's fingers from contacting the blades when the plug is inserted or removed from an electrical outlet. Specifically, the invention relates to a safety device that includes spring-biased detents for connecting the safety device and the electrical plug together.

2. Background of the Invention

There is a growing concern for the safety of infants and young children. Particularly, the concern is for children who have not yet reached the age at which they may be reasoned with and instructed as to the dangers of household electricity. Such children may typically range in age from that of a toddler who may yet only be crawling—typically, seven to 15 months of age—up to preschool aged children who have yet to learn discipline, or have yet to reach the age at which they may be spoken to about the dangers of certain actions which they might undertake.

Almost any home where any such children live or are expected to visit, will possibly have covers placed over any unused wall sockets so as to preclude prying fingers or child-wielded objects from being inserted into the electrical wall sockets. When these covers are in place on unused wall sockets, the danger to a toddler is greatly reduced as the wall socket is not accessible and the covers are difficult to remove. When, however, a household appliance such as a lamp, is plugged into a wall socket, a completely different danger exists. In this instance, the toddler may be enticed to remove and reinsert the plug into the wall socket. This exposes them to the risk of contacting the blades of the electrical plug while they are still live, i.e., while between 110 and 130 volts (in North America) is imposed across the blades. If the blades are contacted by the toddler's fingers, there is a high risk of electric shock to the toddler.

Devices have been proposed in the prior art for reducing such a risk. U.S. Pat. No. 6,577,081 B2, issued Jun. 10, 2003, to the present inventor, discloses such a device. U.S. Pat. No. 6,577,081 discloses a safety device on a transformer for an electrical appliance such as a baby monitor. The transformer has electrical blades projecting outwardly therefrom and a cavity is formed in the transformer housing around the area from which the blades project. An insulator is disposed within the cavity. The insulator is collapsible when the blades are inserted into a wall socket and expandable when the blades are removed from the wall socket. The insulator is in the form of a bellows-like structure that has convoluted and compressible walls.

While this transformer is specifically manufactured to ensure that the electric shock risk to toddlers is reduced, there are numerous standard electric plugs, both grounded and ungrounded, where there is no protective feature to prevent toddlers' fingers from coming into direct contact with the electrical blades of the plugs while they are live. There is therefore a need in the art to provide a safety device for use with standard electrical plugs.

SUMMARY OF THE INVENTION

The object of the present invention is to provide a safety device that may be quickly and easily attached to any suitably shaped electrical wall plug.

The safety device includes a housing with a channel formed so that it opens outwardly away from the front end of the housing and a collapsible shield disposed within the channel. The safety device further includes a connector for securing the housing to an electrical plug. The connector comprises at least one, and preferably two, opposing spring-biased detents which snap-fit to the front end of the plug and lock it against the rear wall of the safety device. The shield preferably is manufactured from a dielectric material and is in the form of a collapsible bellows-type structure. The shield is of a sufficient length to extend substantially to the tips of the blades when the safety device is connected to the plug. The shield collapses as the plug is inserted into a wall socket and expands to its original position when the plug is withdrawn from the wall socket. The shield substantially prevents fingers from coming into contact with the blades during insertion or removal of the plug from the wall socket.

It is contemplated that the safety device will be sold in the form of a kit that will allow a consumer to attach an insulating shield to any electrical plug in their home, daycare facility or the like. The kit may include a preassembled safety device or one in which the various component parts need to be assembled by the consumer before installation of the safety device on an electrical plug.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
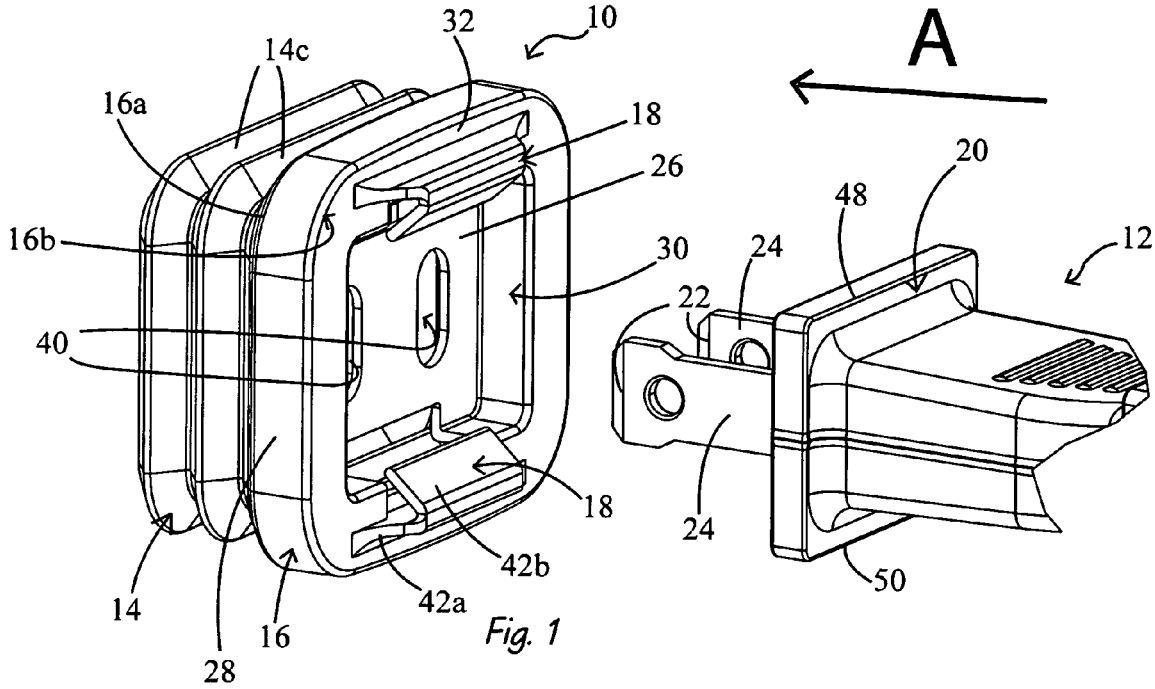
FIG. 1 is a perspective view of a safety device in accordance with the present invention, shown with a standard two-bladed electrical plug, but not connected thereto.
Figure 2:
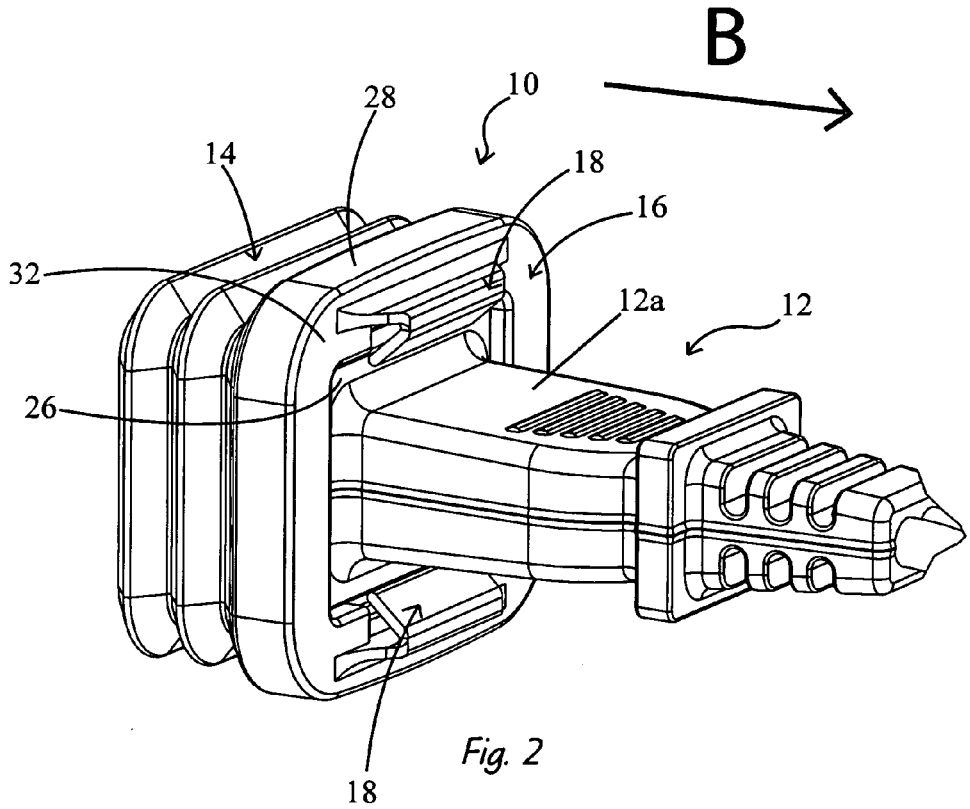
FIG. 2 is perspective view of the safety device secured to the two bladed plug.

Referring to FIGS. 1–4, there is shown a safety device in accordance with the present invention and generally indicated at 10. Safety device 10 is adapted to be attached by a consumer to any complimentary sized and shaped plug 12. Safety device 10 includes a shield 14, a housing 16 and a connector 18 for attaching the housing 16 to the front end 20 of plug 12. Shield 14 extends outwardly from a front end 16*a* of housing 16 and toward the tips 22 of the electrical blades 24. Shield 14 surrounds blades 24 when shield 14 is in its expanded state. Tips 22 of blades 24 may extend slightly beyond the second end 14*b* (FIG. 3) of shield 14 for easier insertion of blades 24 into an electrical outlet or wall socket (not shown). When blades 24 are inserted into the wall socket, shield 14 is compressed or collapsed until front end 20 of plug 12 contacts the wall socket. When plug 12 is withdrawn from the wall socket, shield 14 returns to its uncompressed or original state where it surrounds blades 24 and extends almost to tips 22 of blades 24. During both the insertion and removal of plug 12 from the wall socket, shield 14 prevents the fingers of the user from coming into contact with blades 24.

Referring still to FIGS. 1–4, housing 16 preferably is molded from plastic or manufactured from some other fairly rigid material. Housing 16 has a rear end 16*b* which has a rear wall 26 that preferably defines a recessed area 30. Recessed area is complementary sized and shaped to receive the front end 20 of plug 12 therein. Rear wall 26 defines shoulders 32 which extend around recessed area 30. Recessed area 30 manifests itself as a raised central area on the inner surface 26*a* of rear wall 26 and shoulders 32 manifest themselves as a peripheral channel 36 that surrounds the central area. Two spaced-apart apertures 38 are formed in rear wall 26 and are adapted to receive blades 24 from plug 12 therethrough. It will be understood that instead of two apertures 38, one larger single aperture may be provided for receiving blades 24. Apertures 38 are sized so that they are wider and/or taller than the blades 24 which are to be inserted through them.

Shield 14 preferably is in the form of bellows that are able to expand and collapse as is shown and described in U.S. Pat. No. 6,577,081 B1 issued to the present inventor, the entire specification of which is incorporated herein by reference. Shield 14 preferably is made of a non-conductive and resilient material such as rubber, vinyl, polyvinyl chloride, polyurethane and mixtures, polymers, copolymers and derivatives thereof. It may therefore easily expand and collapse while preventing the accidental flow of electrical current from blades 24 to the fingers of the user. Shield 14 has a first end 14*a* and a second end 14*b* with a plurality of folds 14*c* of material between them. First end 14*a* is received within channel 36 and may be secured therein by friction, an adhesive or any other suitable means. When first end 14*a* is received within channel 36 and shield 14 is not in its collapsed state, second end 14*b* is disposed proximate tips 22 of blades 24. Shield 14 folds up into peripheral channel 36 as blades 24 are inserted into the wall socket. When inner surface 26*a* of rear wall 26 engages the outer surface (not shown) of the wall socket, the shield 14 is fully collapsed and all the folds 14*c* are retained within peripheral channel 36.

In accordance with one of the specific features of the present invention, a connector mechanism 18 is provided for connecting shield 10 to electrical plug 12. The connector mechanism 18 comprises a pair of spring-biased detents 42 which preferably are integrally formed on opposing first and second ends of shoulders 32 (FIG. 1). Detents 42 are illustrated as being formed proximate the top and bottom of housing 16, but they could alternatively be located proximate the sides of housing 16. Furthermore, detents 42 could be provided at the top and bottom and at the sides of housing.

Figure 3:
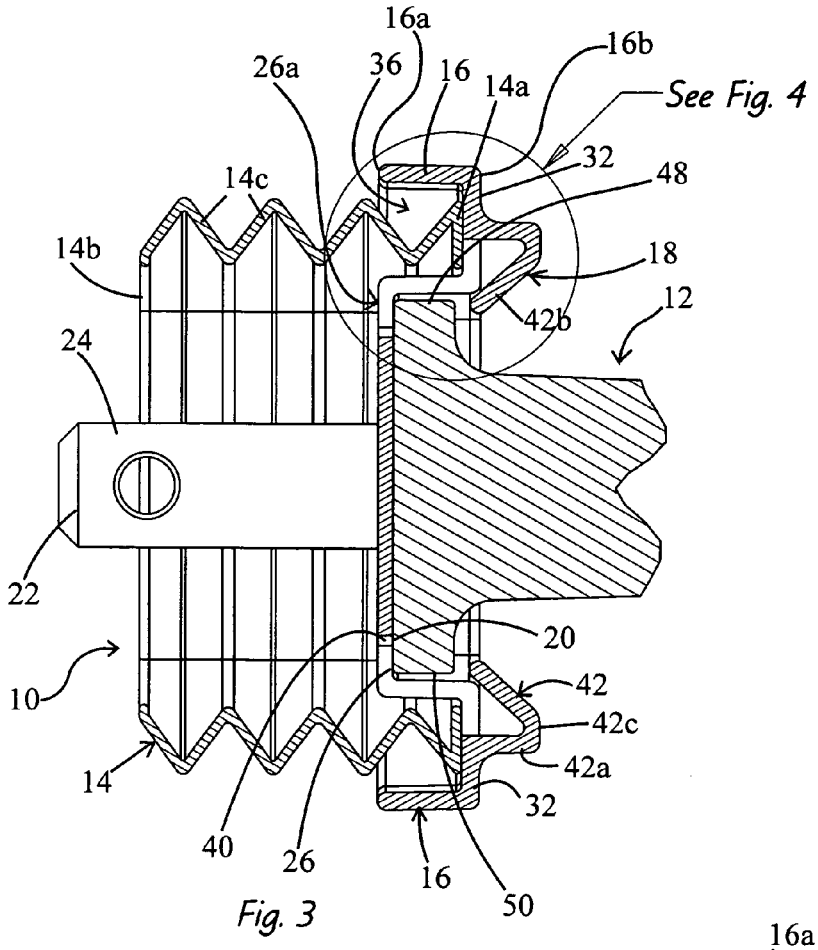
FIG. 3 is a partial cross-sectional side view of the safety device secured to the two bladed plug.
Figure 4:
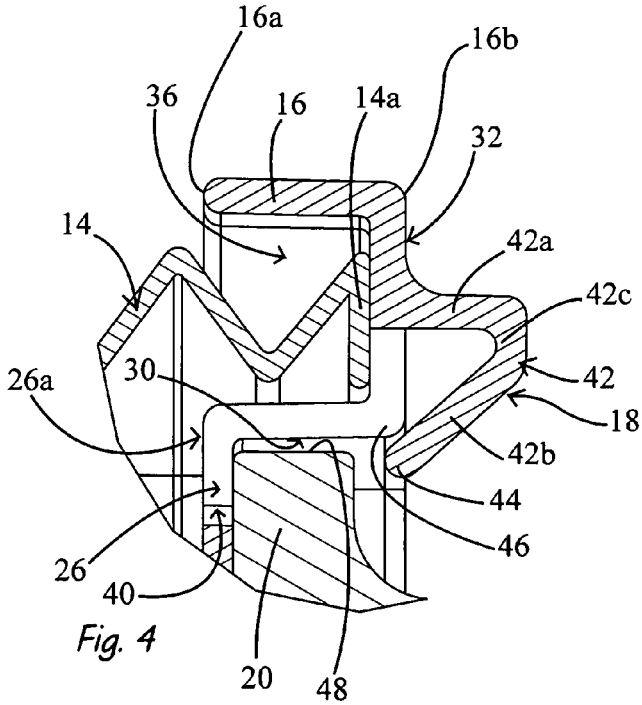
FIG. 4 is an enlargement of the area identified in FIG. 3 and showing the connection between the safety device and the plug.

Detents 42 are substantially V-shaped when viewed from the side, having a first leg 42*a* fixedly connected to shoulder 32 of shield 10 and a free-floating second leg 42*b* which extends outwardly from first leg 42*a*. Each of the first leg 42*a* and second 42*b* are flat, planar walls which preferably do not extend entirely across the width Y–Y" of recessed area 30 (FIG. 1). An intermediate portion 42 is disposed between first leg 42 and second leg 42*b* and is integrally formed therewith. Intermediate portion 42*c* lies substantially parallel to the rear wall 26 of housing 16 (FIG. 3). First leg 42*a* extends outwardly away from and substantially normally to shoulder 32. Second leg 42*b* has a fixed end where second leg 42*b* connects to intermediate portion 42*c* and a free end 44 remote from intermediate portion 42*c*. Second legs 42*b* angle inwardly away from intermediate portion 42*c* and toward rear wall 26 of shield 10 as is shown in FIG. 4. Consequently, free ends 44 of the two second legs 42*b*, lie in closer proximity to each other than do the fixed ends of the two second legs 42*b*. Furthermore, the free end 44 of each second leg 42*b* extends beyond the edge 46 of shoulder 32 and into the recessed area 30 of housing 16 (FIG. 4). Second legs 42*b* of both the upper and lower detents 42 angle inwardly toward recessed area 30 and serve as guides for directing plug 12 into recessed area 30. Free ends 44 of second legs are able to flex slightly moving a small distance relative to first legs 42*a* and toward the edge 46 of rear wall 26.

In use, plug 12 is pushed into contact with safety device 10 by moving plug 12 in the direction of arrow "A" (FIG. 1). The inwardly angled second legs 42*b* of the two detents 42 guide front end 20 of plug 12 into recessed area 30. As device 10 engages plug 12, free ends 44 of second legs 42*b* move or flex outwardly toward the edge 46 of housing 16 and this movement allows front end 20 of plug 12 to move past tips 44 of second legs 42*b* and enter recessed area 30. Front end 20 of plug 12 and legs 42 are snap-fitted together. Because tips 44 of second legs 42*b* extend beyond edge 46 of shoulder 32 and into the recessed area, the tips 44 substantially prevent front end 20 of plug 12 from being moved in the opposite direction and being withdrawn out of recessed area 30. Plug 12 is pushed into recessed area 30 so that tips 22 of blades 24 enter apertures 40. This movement is continued until front end 20 of plug 12 engages rear wall 26 of housing 16. When plug 12 and device 10 are so engaged, shield 14 extends around blades 24 and front edge 14*b* of shield 14 extends almost to the tips 22 of blades 24. Tips 22 of blades 24 are then inserted into a wall socket (not shown) and as the plug's blades 24 are pushed into the wall socket, shield 14 folds up into channel 36 of housing 16. When the user wishes to remove the plug 12 from the wall socket, they grasp the body 12*a* of plug 12 (FIG. 2) and pull in the direction of arrow "B". Blades 24 slide out of the wall socket, the shield 14 expands around blades 24 and thereby prevents the user's fingers from coming into contact therewith.

If the user wishes to completely disengage plug 12 from safety device 10, the second legs 42*b* of detents 40 can be manually moved inwardly toward edge 46 so as to allow the top 48 and bottom 50 of front end 20 of plug 12 to slide past the tips 44 of second legs 42*b*.

It will be understood that while safety device 10 has been disclosed above as being configured to receive a standard two-bladed electrical plug, a safety device in accordance with the present invention may be complementary sided and shaped to receive grounded electrical plugs or any other type, shape or size of electrical plug. Furthermore, while the above safety device 10 has been disclosed as having at least two detents 42, it will be understood that a single detent could be used to connect the safety device 10 and plug 12 together. However, a single detent connector is less desirable in that it would make withdrawing the connected plug and safety device from a wall socket more difficult as the two components would tend to rotate out of contact with each other on one side.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A safety device for connection to an electrical plug for preventing accidental contact with the blades of the plug during insertion and removal thereof from a wall socket, the safety device comprising:

a housing having a rear wall and side walls extending outwardly therefrom;

at least one aperture formed in the rear wall of the housing and adapted to receive the blades of the electrical plug therethrough;

a collapsible shield extending outwardly away from a front end of the housing; said shield being adapted to surround the blades of the electrical plug when the blades extend through the aperture; and at least one connector extending outwardly away from the rear wall of the housing; said connector being adapted to engage a front end of the electrical plug and thereby secure the electrical plug to the housing.

2. The safety device as defined in claim 1, wherein said rear wall of the housing define a recessed area within a back end of the housing; and the recessed area is adapted to receive the front end of the electrical plug therein.

3. The safety device as defined in claim 2, wherein the blade-receiving aperture is formed in the recessed area of the rear wall of the housing.

4. The safety device as defined in claim 1, wherein the connector comprises a first detent having a tip that extends beyond an edge of the rear wall surrounding the recessed area.

5. The safety device as defined in claim 4, wherein the detent is substantially V-shaped when viewed from the side.

6. The safety device as defined in claim 5, wherein the detent comprises a first leg connected normally to the rear wall of the housing and a second leg connected at an angle to the first leg.

7. The safety device as defined in claim 6, wherein the second leg angles inwardly away from the first leg and toward the rear wall of the housing.

8. The safety device as defined in claim 7, wherein the first and second legs of the detent are formed with an intermediate portion disposed therebetween.

9. The safety device as defined in claim 8, wherein said intermediate portion lies substantially parallel to the rear wall of the housing.

10. The safety device as defined in claim 9, wherein the second leg extends inwardly from the intermediate portion and toward the rear wall.

11. The safety device as defined in claim 10, wherein the second leg has a free end and the free end of the second leg is movable relative to the first leg.

12. The safety device as defined in claim 11, wherein the free end of the second leg comprises the tip of the detent which tip is movable toward and away from the edge of the rear wall of the housing.

13. The safety device as defined in claim 12, further comprising a second detent extending outwardly away from the rear wall of the housing;

said second detent being spaced a distance apart from the first detent.

14. The safety device as defined in claim 13, wherein the rear wall of the housing has opposing first and second ends; and the first detent extends outwardly from the first end of the rear wall and the second detent extends outwardly from the second end of the rear wall.

15. The safety device as defined in claim 14, wherein the second legs of the first and second detents each have a free end and a fixed end and the second legs angle inwardly toward each other whereby the free ends thereof lie in closer proximity than do the fixed ends thereof.

16. The safety device as defined in claim 15, wherein the rear wall of the housing defines a recessed area and the blade-receiving aperture is formed in the recessed area of the rear wall; and wherein the recessed area is adapted to receive the front end of the electrical plug therein.

17. A method of attaching a safety device to an electrical plug which has at least two electrical contact blades extending outwardly therefrom, the method comprising the steps of:

a) providing a safety device having a housing with at least one blade-receiving aperture in a rear wall thereof and a collapsible shield extending outwardly therefrom, the shield being adapted to surround the blades when the safety device is attached to the plug; and having a pair opposed connectors extending outwardly from the rear wall and adapted to engage a front end of the plug;

b) guiding the front end of the plug through the opposed connectors;

c) inserting the blades of the plug through the aperture in the housing;

d) pushing the plug toward the rear wall of the housing until the front end of the plug engages the rear wall and the connectors engage the front end to thereby secure the electrical plug to the housing.

18. The method as defined in claim 17, wherein the rear wall of the housing defines a recessed area complementary in size and shape to the front end of the plug; and the step of guiding the front end of the plug through the connectors includes the step of:

guiding the front end of the plug into the recessed area.

19. The method as defined in claim 18, wherein the connectors each include a movable leg which extends inwardly toward the recessed area in the rear wall of the housing; and the step of guiding the front end of the plug through the connectors includes the step of:

contacting the movable legs of the connectors with the front end of the plug;

pushing the front end of the plug inwardly toward the recessed area to cause the movable legs to move toward an edge of the rear wall surrounding the recessed area of the housing.

20. The method as defined in claim 18, further comprising the step of snap-fitting the legs and the front end of the plug together.

* * * * *